US008479852B2

(12) United States Patent
Maurer et al.

(10) Patent No.: US 8,479,852 B2
(45) Date of Patent: Jul. 9, 2013

(54) VEHICLE COMPONENT AIR FLOW DUCTING SYSTEM

(75) Inventors: Michael W. Maurer, Dublin, OH (US); Christopher Meeks, Marysville, OH (US); Jason A. Widmer, Marysville, OH (US); Karl Forster, Powell, OH (US); Sukwon Kim, Marysville, OH (US); Andy Praseteo, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 232 days.

(21) Appl. No.: 13/021,826

(22) Filed: Feb. 7, 2011

(65) Prior Publication Data

US 2012/0199316 A1 Aug. 9, 2012

(51) Int. Cl.
*B60K 11/04* (2006.01)
*B60K 11/08* (2006.01)

(52) U.S. Cl.
USPC ..... 180/68.2; 180/68.4; 165/41

(58) Field of Classification Search
USPC ..... 180/68.1, 68.2, 68.3, 68.4, 68.6; 165/41, 165/42, 43
See application file for complete search history.

(56) References Cited

U.S. PATENT DOCUMENTS

| | | | | |
|---|---|---|---|---|
| 4,938,303 | A | 7/1990 | Schaal et al. | |
| 5,551,505 | A * | 9/1996 | Freeland | 165/41 |
| 6,070,933 | A | 6/2000 | Tsukidate et al. | |
| 6,543,525 | B2 | 4/2003 | Kalbacher | |
| 7,814,963 | B2 | 10/2010 | Adamson et al. | |
| 2008/0115528 | A1 | 5/2008 | Yamamoto et al. | |
| 2009/0139786 | A1 | 6/2009 | Lee | |
| 2010/0083917 | A1 | 4/2010 | Saida et al. | |

FOREIGN PATENT DOCUMENTS

| | | |
|---|---|---|
| JP | 2007-091061 | 4/2007 |
| JP | 2009-248624 | 10/2009 |
| JP | 2010-007629 | 1/2010 |
| JP | 2010-083217 | 4/2010 |

* cited by examiner

*Primary Examiner* — John Walters
(74) *Attorney, Agent, or Firm* — Rankin, Hill & Clark LLP

(57) ABSTRACT

A vehicle transmission fluid cooler system includes a transmission fluid cooler and an airflow ducting assembly engaged therewith. The airflow ducting assembly is provided to increase the amount of airflow directed toward the transmission fluid cooler so as to improve the cooling performance thereof, and includes a dam member, a duct member, and air guides. The duct member forms a passage communicating an airflow inlet opening with an airflow outlet opening. The dam member operates to scoop and direct airflow into the airflow inlet opening, and the air guides cooperate with the dam member to increase the amount of airflow scooped by the dam member which is directed into the airflow inlet opening. The airflow outlet opening is positioned to direct the airflow which has passed through the duct member to the transmission fluid cooler.

18 Claims, 3 Drawing Sheets

VEHICLE COMPONENT AIR FLOW DUCTING SYSTEM

BACKGROUND

The present disclosure generally relates to an airflow ducting structure associated with a vehicle component, and more particularly relates to a vehicle automatic transmission fluid cooler airflow ducting system.

It is known that certain vehicular components may heat, and overheat, during use. The heating of these vehicular components may lead to a degradation of vehicle performance, as well as damage to the overheated vehicular component(s) or other vehicular components. As such, various systems and assemblies have been proposed to facilitate the cooling of those vehicular components which are at risk of overheating and thereby degrading vehicle performance or damaging vehicular components.

For example, transmission fluid coolers are devices which facilitate the cooling of vehicle transmission fluid. Vehicle transmission fluid coolers, particularly vehicle automatic transmission fluid coolers, are heat exchangers which operate to transfer heat from hot transmission fluid as the hot transmission fluid flows through the transmission fluid cooler. The heat exchange or transfer operation is facilitated by a series of tubes through which the transmission fluid flows. Fins connected to the tubes are used to conduct heat from the transmission fluid disposed within the tubes. Other vehicular cooling components, such as vehicle radiators, may operate under a similar principle.

While heat exchanging vehicular cooling components may operate to cool vehicle fluids (such as vehicle transmission fluid) to a certain extent, exposing certain vehicular cooling components to an airflow may facilitate and improve the cooling operations thereof. To increase the amount of airflow received by the vehicular cooling components, vehicles may be provided with openings in the vicinity of an engine compartment which allow ram air to enter the engine compartment. However, ram air entering the engine compartment may disperse upon entry and/or may not be properly directed to maximize the cooling operation of the vehicular cooling components.

SUMMARY

According to one aspect of the instant disclosure, a vehicle transmission fluid cooler assembly includes a vehicle transmission fluid cooler and an airflow ducting assembly. The airflow ducting assembly is secured to the vehicle transmission fluid cooler and includes an air dam member which extends in a substantially downward direction from a lower portion of the vehicle transmission fluid cooler. The dam member is configured to direct airflow toward the vehicle transmission fluid cooler.

According to another aspect, a vehicle front end structure includes a vehicle component housing and a vehicle transmission fluid cooler assembly housed within the vehicle component housing. The vehicle transmission fluid cooler assembly includes a vehicle transmission fluid cooler and an airflow ducting assembly. The airflow ducting assembly is positioned in a forward and upstream direction relative to the vehicle transmission fluid cooler and is configured to direct airflow toward the vehicle transmission fluid cooler.

According to still another aspect, a vehicle transmission fluid cooler airflow ducting system is configured to engage and direct airflow toward a vehicle transmission fluid cooler. The vehicle transmission fluid cooler airflow ducting system includes a ducting member and a dam member. The ducting member defines an airflow passage connecting an airflow outlet opening to an airflow inlet opening, and is configured to engage a vehicle transmission fluid cooler such that the airflow outlet opening directs airflow toward the vehicle transmission fluid cooler. The dam member is secured to the ducting member and extends downwardly therefrom such that a lower edge of the dam member is disposed below a lower edge of the vehicle transmission fluid cooler. The vehicle transmission fluid cooler airflow ducting system may also include a pair of air guides secured to and extending in a forward direction from each of opposed lateral ends of the air dam member. The air guides may also have a top end which connects with a lower portion of the air duct member.

DETAILED DESCRIPTION

Figure 1:
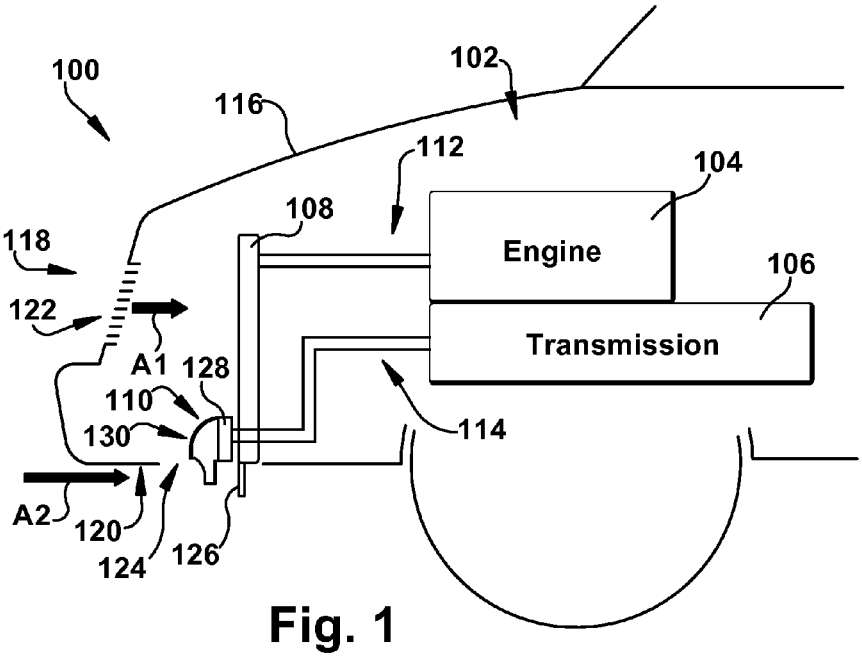
FIG. 1 is a schematic view illustrating a vehicle component housing having a vehicle transmission fluid cooler assembly housed therein.

The description and drawings herein are merely illustrative and various modifications and changes can be made in the structures disclosed without departing from what is defined in the appended claims. All references to direction and position, unless otherwise indicated, refer to the orientation of the structures and components illustrated in the drawings and should not be construed as limiting the claims appended hereto. Like numbers refer to like parts throughout the several views.

With further respect to references to direction and position, it is noted that references to a forward direction are intended to indicate a forward direction of a vehicle or vehicular components, references to a rearward direction are intended to indicate a rearward direction of the vehicle or vehicular components, references to a lateral direction are intended to indicate a side-to-side direction of the vehicle or vehicular components, and reference to an upward and/or downward direction are intended to indicate an up-and-down direction relative to the vehicle or vehicular components. Additionally, references to upstream or downstream directions are used in reference to a direction of airflow, as such is described below. Generally, the forward direction may correspond to the upstream direction and the rearward direction may correspond to the downstream direction.

With reference to FIG. 1, a vehicle front end structure 100 includes a vehicle component housing 102 defined therein. The vehicle component housing 102 is a generally or substantially enclosed portion of the vehicle front end structure 100 in which various vehicle components may be housed. For example and as illustrated in FIG. 1, a vehicle engine 104, a transmission 106, a radiator 108, and a transmission fluid cooling assembly 110 may be housed within the vehicle component housing 102. It is to be appreciated that other vehicle components (not shown) may also be housed within the vehicle component housing 102.

With more particular respect to the illustrated vehicle components housed within the vehicle component housing 102, the engine 104 is generally provided to serve as a power source for the vehicle, and the radiator 108 is provided to facilitate cooling of the engine 104. The engine 104 is connected to the radiator 108 via engine lines 112, which may be configured to transfer engine fluids between the engine 104 and the radiator 108 so that the radiator 108 may cool the engine fluids. In this regard, the radiator 108 may facilitate cooling of the vehicle engine 104 by receiving engine fluids from the engine 104 via the engine lines 112, cooling the engine fluids, and directing the cooled engine fluids back to the engine 104 via the engine lines 112. Vehicle engines and radiators are considered to be generally well-known, and as such the engine 104 and the radiator 108 will not be described in detail herein.

The transmission 106 is operationally engaged with the engine 104 and functions to translate power generated by the engine 104 to drive the vehicle. The herein described transmission 106 is an automatic transmission which utilizes automatic transmission fluid. However, it is to be appreciated that the instant disclosure is amenable for use with other types of vehicle transmissions which utilize a transmission fluid. Vehicle transmissions are considered to be generally well-known, and as such the transmission 106 will not be described in further detail herein.

With continuing reference to FIG. 1, the transmission 106 is connected to and communicates with the transmission fluid cooling assembly 110 via transmission fluid lines 114. The transmission fluid lines 114 are configured to communicate transmission fluid (e.g., automatic transmission fluid) between the transmission 106 and the transmission fluid cooling assembly 110. The transmission fluid cooling assembly 110 is provided to facilitate cooling of the transmission 106, and is disposed in a forward direction relative to the radiator 108. In operation, hot transmission fluid is directed to the transmission fluid cooling assembly 110 from the transmission 106 via the transmission fluid lines 114. The transmission fluid cooling assembly 110 cools the hot transmission fluid and directs the cooled transmission fluid back to the transmission 106 via the transmission fluid lines 114.

Both the radiator 108 and a transmission fluid cooling assembly 110 may be provided as heat exchanging type cooling mechanisms which are configured to cool the engine 104 and transmission 106, respectively. Heat exchanging type cooling mechanisms may include a series of tubes through which hot fluid (e.g., engine fluid and/or transmission fluid) passes, and a series of fins connected to the tubes and configured to draw heat from the hot fluids held within the tubes. Additionally, heat exchanging type cooling devices, such as the herein described radiator 108 and transmission fluid cooling assembly 110, may operate in an improved manner when an airflow impinges thereon (e.g., contacts, passes through, etc.). In this regard, the efficiency of the cooling operation performed by the radiator 108 and the transmission fluid cooling assembly 110 improves as a greater amount of airflow impinges thereon. As such, though generally or substantially enclosed, the vehicle component housing 102 may be provided with openings which allow airflow to enter therein.

With more particular respect to the vehicle component housing 102, the enclosure thereof is generally defined on an upper end by a vehicle hood 116, along a front end by a vehicle front fascia 118, and along a lower end by a lower wall 120. While the vehicle hood 116, front fascia 118, and lower wall 120 may have particular meanings within the art, as used herein, these terms are intended to serve as general descriptors of boundary elements defining the vehicle component housing 102. It is to be appreciated that other vehicle elements may be used to facilitate the defining of the boundary of the vehicle component housing 102, and that the vehicle component housing 102 may also be bounded along lateral sides by these other vehicle elements. As described herein, the vehicle hood 116 is used to reference the upper end boundary of the vehicle component housing 102, the front fascia 118 is used to reference the front end boundary of the vehicle component housing 102, and the lower wall 120 is used to reference the lower end boundary of the vehicle component housing 102. Insofar as a conventional vehicle may be constructed to utilize other elements to define the vehicle component housing (quarter panels, etc.), these element will not be described in detail. Nevertheless, it is to be appreciated that the vehicle component housing 102 may be bounded along any and all sides in any manner using any parts of the vehicle.

To facilitate the introduction of airflow into the vehicle component housing 102, the front fascia 118 may be configured to have ram air openings 122 defined therethrough. The ram air openings 122 may generally be a series of openings formed through the front fascia 118 which facilitate the introduction of an upper airflow A1 into the vehicle component housing 102. The ram air openings 122 may be formed in a vehicle grill provided in the front fascia 118, may be formed through portions of a bumper of the front fascia 118, or may be provided in any other manner.

Furthermore, the lower wall 120 may also be provided with at least one bottom breather opening 124 configured allow a lower airflow A2 to be introduced into the vehicle component housing 102. The at least one bottom breather opening 124 is an opening formed through the lower wall 120 which is configured to allow an airflow or a ram airflow to enter the vehicle component housing 102 from a lower end thereof. The bottom breather opening 124, as illustrated, may define an opening extending between 6 and 18 inches in a front-to-rear direction of the vehicle 100 which allows an airflow passing below the vehicle 100 (e.g., below the vehicle lower wall 120) to be introduced into the vehicle component housing 102 from a lower portion thereof. The lower airflow A2 may be directed in a generally upward and rearward direction upon entering the vehicle component housing 102 by providing the bottom breather opening 124 with an angled entry head (not shown).

As used herein, the term "ram airflow" generally denotes airflow that is generated due to the forward motion of a vehicle. In other words, as a vehicle moves in a forward direction, even stagnant air in the way of the vehicle may take on a velocity in a rearward direction relative to the moving vehicle and become airflow. The ram airflow may be introduced into the vehicle component housing 102 via the ram air openings 122 and the bottom breather opening 124 while the vehicle is in motion. It is to be appreciated that the ram air openings 122 and the bottom breather opening 124 are also capable of facilitating the introduction of any other type of airflow into the vehicle component housing 102.

It is noted that the precise number and/or the positioning of the ram airflow openings 122 and bottom breather openings 124 may be varied or adjusted based on any of several considerations. For example, depending on the precise configuration of the vehicle component housing 102 and/or the disposition of the vehicle components within the vehicle component housing 102, the number and position of the ram airflow openings 122 and bottom breather openings 124 may be altered. It is further noted that additional and/or alternative airflow intake openings may be provided. For example, airflow intake openings may similarly be formed in the vehicle hood 116 and/or in vehicle elements defining lateral sides of the vehicle component housing 102. The ram air openings 122 and the bottom breather opening 124 are generally and exemplarily described herein, and are not intended to limit the type, number, and/or positioning of airflow intake openings which allow an airflow to be introduced into the vehicle component housing 102.

As illustrated in FIG. 1, the ram air openings 122 and at least a forward edge of the bottom breather opening 124 are positioned in a relatively forward upstream direction from the transmission fluid cooling assembly 110 and the radiator 108. This positioning may increase the amount of airflow which reaches the radiator 108 and the transmission fluid cooling assembly 110 by ensuring that airflow introduced into the vehicle component housing 102 is not already downstream (e.g., rearward) from the cooling components which would benefit from interaction with the airflow. In this regard, as only the engine 104 and transmission 106 are illustrated and described, the radiator 108 and transmission fluid cooling assembly 110 are the only cooling components illustrated and described herein. It is to be appreciated that other vehicular cooling components which would benefit from interaction with the introduced airflow may also be positioned in a rearward downstream direction from the ram airflow opening 122 and/or the bottom breather opening(s) 124.

In addition to providing the ram air openings 122 and the bottom breather opening 124 (as well as any other airflow introducing openings), airflow directing members may be provided within the vehicle component housing 102 so as to increase the amount or the percentage of the introduced airflow which impinges on or contacts the radiator 108 and the transmission fluid cooling assembly 110 (as well as other cooling components). The airflow directing members may be secured to the vehicle component housing 102, any of the vehicle components housed within the vehicle component housing 102, and/or any other portion of the vehicle. In this regard, it is noted that, when provided, the angled entry head of the bottom breather opening 124 may be considered to be an airflow directing member.

Figure 2:
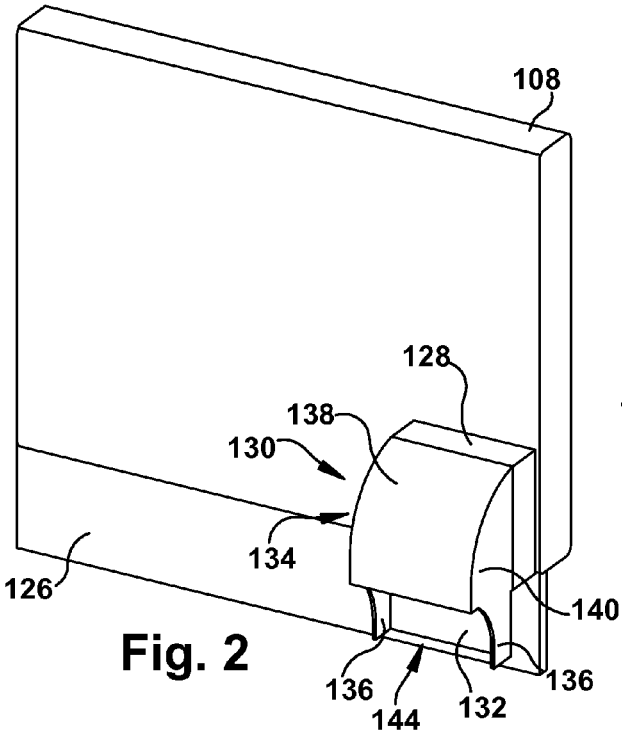
FIG. 2 is a perspective view illustrating a vehicle radiator, transmission fluid cooler, and transmission fluid cooler airflow ducting assembly.
Figure 3:
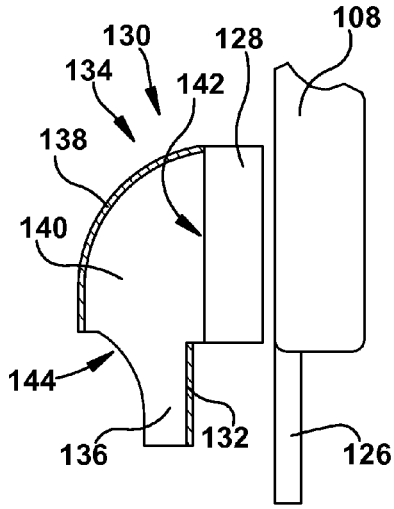
FIG. 3 is a side view illustrating the vehicle radiator, transmission fluid cooler, and a cross-sectional view of the transmission fluid cooler airflow ducting assembly including a ducting member and a dam member.

As shown in FIGS. 1-3, another airflow directing member is a radiator air dam 126, which is provided to increase the amount of airflow which reaches the radiator 108. The radiator air dam 126 is a generally planer member having a width, i.e., lateral, dimension which is substantially equal to that of the radiator 108. The radiator air dam 126 is secured at an upper end to a front portion of a lower edge of the radiator 108, and extends in a substantially downward direction therefrom. As illustrated, the radiator 108 and radiator air dam 126 may be positioned such that the radiator air dam 126 protrudes through the bottom breather opening 124 and has a lower edge which is disposed below the vehicle component housing lower wall 120. It is noted that insofar as the dam member 134 and the radiator air dam 126 may protrude from the bottom breather opening 124, these members may still considered to be housed within the vehicle component housing 102.

The radiator air dam 126 is configured to scoop airflow which impinges thereon in an upward direction toward the radiator 108. In operation, the lower airflow A2 passing beneath the vehicle 100 impinges on (e.g., contacts) the radiator air dam 126, which scoops and directs the lower airflow A2 in an upward direction toward the radiator 108. Through this operation, the radiator air dam 126 increases the amount of the lower airflow A2 which reaches the radiator 108, and thereby increases the amount of airflow reaching the radiator 108.

It is noted that, in addition to the redirected airflow received by the radiator 108 from the radiator air dam 126, some portion of the upper airflow A1 any other introduced airflows (such as a portion of the lower airflow A2 which may enter the vehicle component housing 102 via the bottom breather opening 124 without interaction with the radiator air dam 126) may directly impinge or contact the radiator 108. A total airflow reaching the radiator 108 includes directly impinging airflow (e.g., airflow which is not redirected by the radiator air dam 126) and redirected airflow (e.g., airflow which is redirected by the radiator air dam 126). As such, the total airflow reaching the radiator 108 equipped with the radiator air dam 126 is greater than that which would reach the radiator 108 if the radiator air dam 126 were not equipped. The increased airflow reaching the radiator 108 improves the cooling performance of the radiator 108.

Additional airflow directing member(s) are provided by the transmission fluid cooling assembly 110. In this regard, the transmission fluid cooling assembly 110 includes a transmission fluid cooler 128 and an airflow ducting assembly 130. The transmission fluid cooler 128 is the heat-exchanging portion of the transmission fluid cooling assembly 110 which may include the above-referenced series of tubes and fins. As is consistent with the herein described embodiment, the transmission fluid cooler 128 may be an automatic transmission fluid cooler, and is the portion of the transmission fluid cooling assembly 110 which is in communication with the transmission 106 via the transmission fluid lines 114. It is noted that transmission fluid coolers, such as the transmission fluid cooler 128 described herein, are considered to be a generally well-known heat exchanging type vehicle cooling components which operate to cool transmission fluid from the vehicle transmission 106. As such, the transmission fluid cooler 128 will not be described in further detail herein.

To facilitate and improve the operation of the transmission fluid cooler 128, the airflow ducting assembly 130 is provided as an airflow directing member. The airflow ducting assembly 130 is generally provided to increase the amount of airflow which reaches (e.g., is directed to) the transmission fluid cooler 128 so as to improve the cooling performance of the transmission fluid cooler 128. As illustrated in FIGS. 2 and 3, the airflow ducting assembly 130 may be secured to, or otherwise engage, the transmission fluid cooler 128 so as to be disposed on a front or upstream side (e.g., surface) of the transmission fluid cooler 128.

The airflow ducting assembly 130 of the transmission fluid cooling assembly 110 may be formed of a dam member 132, a duct member 134, and (a pair of) air guides 136. The dam member 132, duct member 134, and air guides 136 forming the airflow ducting assembly 130 may be formed of a plastic or any other suitable material. Moreover, the dam member 132, the duct member 134, and the air guides 136 may be integrally formed as a unitary piece. Alternatively, the dam member 132, the duct member 134, and the air guides 136 may be secured to one another via any known securing means.

The dam member 132 may be a substantially planar member provided to extend in a generally downward direction from a front portion of a lower edge of the transmission fluid cooler 128. As with the radiator 108 and radiator air dam 126, the transmission fluid cooler 128 and the airflow ducting assembly 130 may be positioned such that the dam member 132 and the air guides 136 (described in further detail below) extend from the bottom breather opening such that a lower edge 148 of the dam member 132 is positioned below the vehicle component housing lower wall 120. In this regard, the dam member 132 is provided such that the lower airflow A2 passing beneath the vehicle 100 may impinge on the dam member 132 and thereby be scooped and directed in an upward direction into the vehicle component housing 102 and toward the transmission fluid cooler 128. Through this redirection of the lower airflow A2, the amount of airflow reaching the transmission fluid cooler 128 may increase, thereby improving the performance of the transmission fluid cooler 128. As is described in further detail below, the dam member 132 may be alternatively configured to increase the amount of airflow which impinges thereon that is directed in an upward direction to reach the transmission fluid cooler 128.

It is noted that the transmission fluid cooling assembly 110, as illustrated in FIGS. 1-3, may be disposed in a forward upstream direction from the radiator 108. As is also illustrated, the transmission fluid cooling assembly 110 may be positioned so as to overlap a lower side portion of a front surface of the radiator 108. Further, the dam member 132 may consequently be positioned to partially overlap with the radiator air dam 126.

More particularly, the dam member 132 may have a width, i.e., lateral, dimension substantially equal to a width dimension of the transmission fluid cooler 128, which, as shown in the appended drawings, is less than a width dimension of the radiator air dam 126 and the radiator 108. Additionally, a height dimension of the dam member 132 may be set such that a lower edge of the radiator air dam 126 is situated relatively below a lower edge of the dam member 132. With regard to the herein described dimensional features of the dam member 132, the dam member 132 may be provided so as to increase the amount of airflow directed to the transmission fluid cooler 128 without substantially interfering with the operation of the radiator air dam 126 (e.g., limiting the amount of air directed to the radiator 108 by the radiator air dam 126).

The duct member 134 is joined to the dam member 132 so as to be situated above the dam member 132. As shown in FIG. 1, the duct member 134 may be substantially entirely disposed within the vehicle component housing 102, e.g., a lower edge of the duct member 134 is positioned above the vehicle component housing lower wall 120. Generally, the duct member 134 forms an enclosed or substantially enclosed passage communicating an airflow inlet opening 144 at a forward upstream side with an airflow outlet opening 142 at a rearward downstream side. More particularly, the duct member 134 may be formed of a front wall 138 and a pair of sidewalls 140 which cooperate with one another and the dam member 132 to define the passage, the airflow inlet opening 144, and the airflow outlet opening 142.

The duct member front wall 138, when viewed from a side as shown in FIG. 3, may have a generally arcuate shape extending downwardly and forwardly from an upper rear edge toward a lower front edge. The side walls 140 are provided to form side surfaces of the duct member 134, and in this regard extend in a generally rearward direction from the front wall 138 toward the transmission fluid cooler 128. The airflow outlet opening 142 is defined by the upper rear edge of the front wall 138 and rear portions of the side walls 140. The airflow inlet opening 144 is defined by the front lower edge of the front wall 138, lower portions of the side walls 140, the dam member 132, and the air guides 136 (which are described in further detail below). It is noted that the front lower edge of the duct member front wall 138 may be disposed to be substantially vertically aligned with, or above, the lower wall 120 and bottom breather opening 124.

The air guides 136 are provided on each of opposed lateral side edges of the dam member 132 and extend in a generally forward or upstream direction from the dam member 132. Lower edges of the air guides 136 are generally flush with the lower edge of the dam member 132, and upper edges of the air guides 136 are joined with the side walls 140 of the duct member 134. The air guides 136 are generally provided to cooperate with the dam member 132 such that redirected airflow from the dam member 132 is laterally contained by the air guides 136. The lateral containment performed by the air guides 136 may serve to increase the amount of airflow directed to the transmission fluid cooler 128 by the airflow ducting assembly 130.

As illustrated in FIGS. 1-3, the airflow ducting assembly 130 is configured to be secured to or otherwise engage the transmission fluid cooler 128 using any known securing means, such as mechanical fasteners, adhesives, etc. More particularly, the airflow ducting assembly 130 may be secured to the front or upstream surface of the transmission fluid cooler 128 through attachment of the side walls 140 and the upper rear edge of the front wall 138 of the duct member 134 to the front upstream surface of the transmission fluid cooler 128. Alternatively, the duct member front and side walls 138, 140 may be configured to be secured to side and upper edges of the transmission fluid cooler 128, or to be secured to another vehicle component or portion of the vehicle in the vicinity of the transmission fluid cooler 128.

The airflow ducting assembly 130 may be positioned such that the airflow outlet opening 142 communicates with the front or upstream surface of the transmission fluid cooler 128. As generally shown in FIGS. 2 and 3, the airflow outlet opening 142 may be sized and shaped so as to substantially correspond to the size and shape of the front or upstream surface of the transmission fluid cooler 128 (e.g., a generally rectangular shape having an area equal to or slightly less than an area of the front or upstream surface of the transmission fluid cooler 128). Moreover, a plane defined by the airflow outlet opening 142 may, as shown in FIG. 3, be substantially flush with the front or upstream surface of the transmission fluid cooler 128. As such, any airflow entering the airflow ducting assembly 130, particularly the duct member 134, through the airflow inlet opening 144 is directed toward the front or upstream surface of the transmission fluid cooler 128. In this regard, the airflow ducting assembly 130, and particularly the duct member 134, is provided to communicate redirected airflow to the transmission fluid cooler 128 through the airflow outlet opening 142.

With respect to the operation of the transmission fluid cooling assembly 110 and the airflow ducting assembly 130 thereof, it is noted that some portion of the upper airflow A1 entering the vehicle component housing 102 through the ram air openings 122 may directly impinge upon a front surface of the radiator 108. Additionally, some portion of the lower airflow A2 passing beneath the vehicle may impinge on the non-overlapped (and/or the overlapped portion) of the radiator air dam 126 and the dam member 132 of the airflow ducting assembly 130. Furthermore, some portion of the lower airflow A2 may, without redirection, enter the vehicle component housing 102 through the bottom breather opening 124 and directly impinge on the radiator 108. As noted above, airflow which impinges upon the radiator air dam 126 may then be directed toward the radiator 108 so as to facilitate a cooling operation of the radiator 108, and airflow which impinges on the dam member 132 may be directed into the duct member 134 and toward the transmission fluid cooler 128.

With particular respect to the operation of the airflow ducting assembly 130 of the transmission fluid cooling assembly 110, an airflow, such as the ram airflow passing beneath the vehicle 100 (e.g., the lower airflow A2), which impinges or contacts the dam member 132 is scooped or redirected toward and into the airflow inlet opening 144 of the airflow ducting assembly 130. The air guides 136 disposed on side edges of the dam member 132 provide lateral containment and prevent and/or reduce the amount of airflow which impinges upon the dam member 132 and does not enter the airflow inlet opening 144. The duct member 134 serves as a generally enclosed passage communicating the airflow inlet opening 144 with the airflow outlet opening 142 so as to ensure that all or at least most of the airflow introduced into the duct member 134 through the airflow inlet opening 144 is caused to be dispensed from the airflow outlet opening 142 toward the transmission fluid cooler 128.

It is to be appreciated that the transmission fluid cooling assembly 110, and more particularly the airflow ducting assembly 130, may be alternately configured, constructed, or positioned so as to facilitate an increase in the amount of airflow which reaches the transmission fluid cooler 128. In this regard, the entire transmission fluid cooling assembly 110 may be repositioned relative to the radiator 108 or other vehicle components. For example, the transmission fluid cooling assembly 110 may be repositioned such that the dam member lower edge 148 is disposed above the vehicle component housing lower wall 120. It is further noted that the radiator 108 may also be positioned such that the lower edge of the radiator air dam 126 is disposed above the vehicle component housing lower wall 120.

Additionally, the airflow ducting assembly 130 may be alternately configured so as to increase the amount of airflow directed toward the transmission fluid cooler 128, to alter (e.g., increase/decrease) a velocity of the airflow passing through the ducting assembly 130, and/or to account for various design considerations within the vehicle component housing 102, such as space limitations which may exist therein. It is to be appreciated that the duct member 132 may not have the precise shape or configuration illustrated in FIGS. 1-3, and may alternatively take the form of any passage configured to receive an airflow introduced into the vehicle component housing 102 within an airflow inlet opening 144 and to dispense the received airflow through an airflow outlet opening 142 to the transmission fluid cooler 128. For example, the duct member 132 may be configured such that the airflow inlet opening 144 is larger than the airflow outlet opening 142, which may operate to increase a velocity of the airflow reaching the transmission fluid cooler 128 through the airflow ducting assembly 130.

Figure 4:
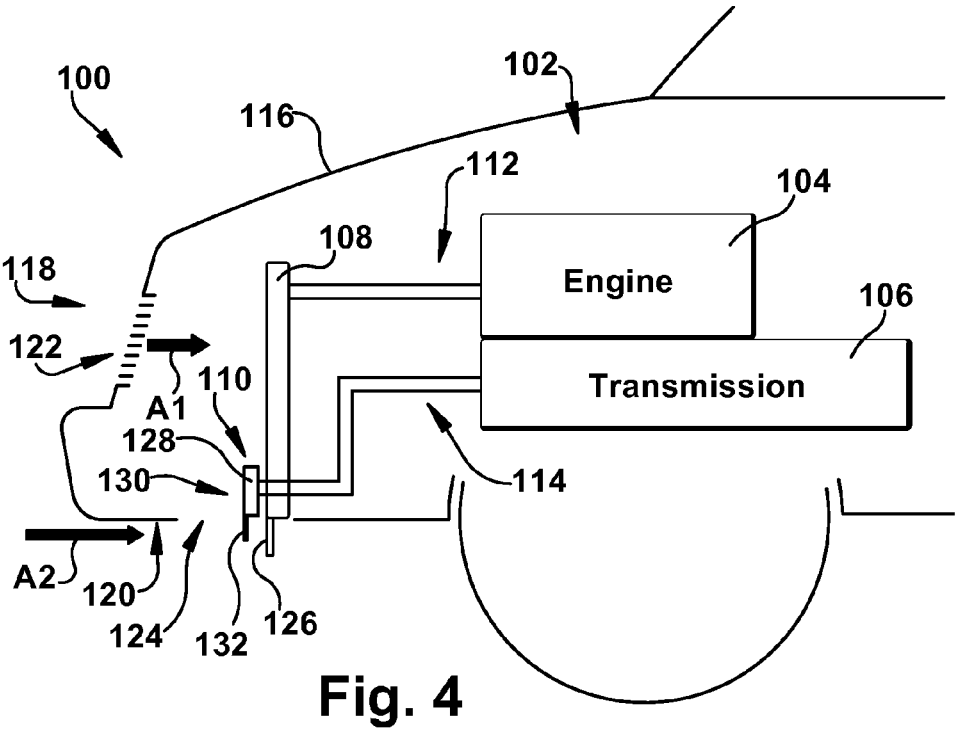
FIG. 4 is a schematic view illustrating a vehicle component housing having a transmission fluid cooler airflow ducting assembly having a dam member.
Figure 5:
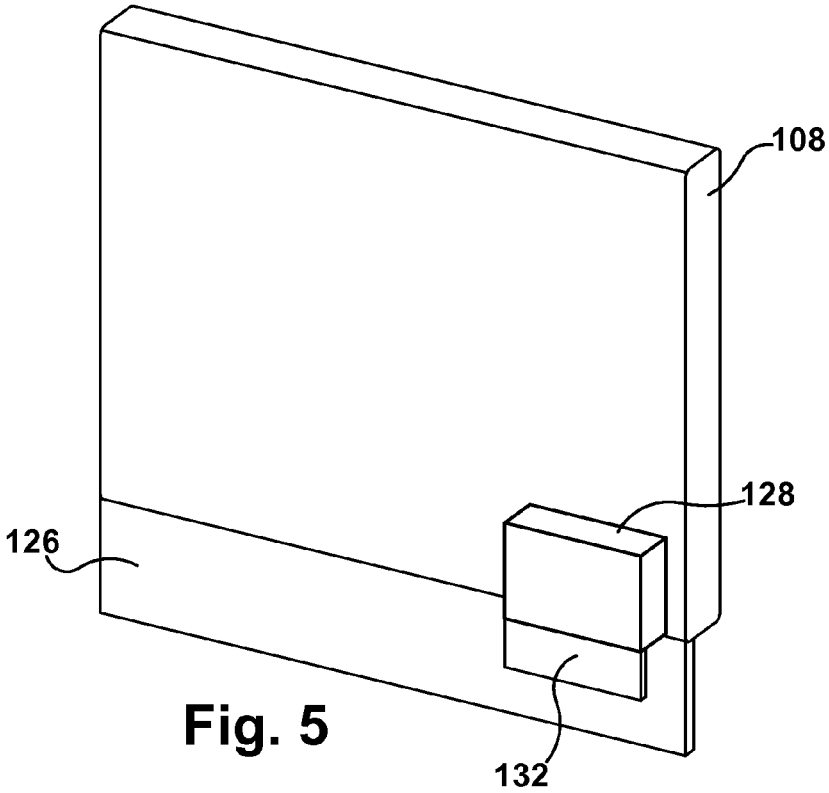
FIG. 5 is a perspective view illustrating the vehicle radiator, transmission fluid cooler, and transmission fluid cooler airflow ducting assembly shown in FIG. 4.

As noted above, various design considerations related to the vehicle component housing 102 and other factors may require the airflow ducting assembly 130 be reconfigured to account for size constraints. In this regard, with reference to FIGS. 4 and 5, the airflow ducting assembly 130 is shown with a space-efficient configuration. Generally, the space-efficient configuration of the airflow ducting assembly 130 includes only the dam member 132. The dam member 132, when utilized in the space-efficient configuration, is generally provided and configured in a manner identical to that of the above-described airflow ducting assembly 130 which includes the dam member 132, the duct member 134, and the air guides 136. It is to be appreciated that the space-efficient configuration of the airflow ducting assembly 130 may be further modified to incorporate the air guides 136 and/or a modified or partial duct, and may also employ a relatively smaller bottom breather opening 124.

Figure 6A:
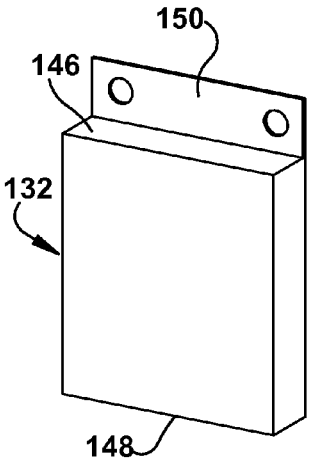
FIG. 6A is a perspective view illustrating a planar dam member having a first connecting member.
Figure 6B:
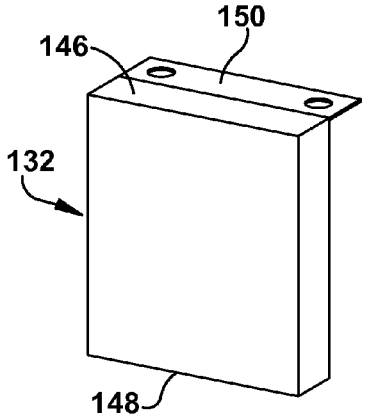
FIG. 6B is a perspective view illustrating a planar dam member having a second connecting member.
Figure 6C:
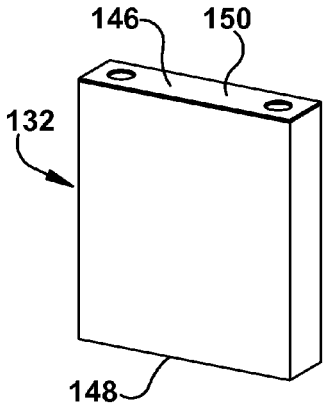
FIG. 6C is a perspective view illustrating a planar dam member having a first connecting member.

The above described dam member 132 is illustrated in isolation in FIGS. 6A-6C. As shown therein, the dam member 132 has a body with an upper edge 146 which is substantially aligned with and disposed above the lower edge 148. Exemplary embodiments of the generally planar dam member 132 shown in FIGS. 6A-6C illustrate various alternative configurations for a connecting member 150 incorporated with the dam member 132 and configured to facilitate attachment of the dam member 132, and/or the entire airflow ducting assembly 130 (when the duct member 134 and the air guides 136 are also employed), to the transmission fluid cooler 128. Particularly, the connecting member 150 may be incorporated in the upper edge 146 of the dam member 132 (as shown in FIG. 6C); may extend in an upward direction aligned and flush with a rear surface of the dam member 132 (as shown in FIG. 6A); or may extend in a rearward direction so as to be generally flush with the upper edge 146 of the dam member 132 (as shown in FIG. 6B). The selection of any of the connecting member 150 configurations may be dependent upon design constraints or other factors.

Applicant has performed CAE modeling to determine the effectiveness of the herein described airflow ducting assembly 130. In the space-efficient airflow ducting assembly 130 (e.g., an assembly utilizing only the dam member 132), Applicant's modeling determined that the amount of airflow directed to the transmission fluid cooler 128 will increase by 300% as compared to a configuration without the airflow ducting assembly 130. Further, CAE modeling directed to the above-described airflow ducting assembly 130 which utilizes the dam member 132, the duct member 134, and the air guides 136 has determined that the amount of airflow received by the transmission fluid cooler 128 will increase by 400% as compared to a configuration without the airflow ducting assembly 130.

Figure 7A:
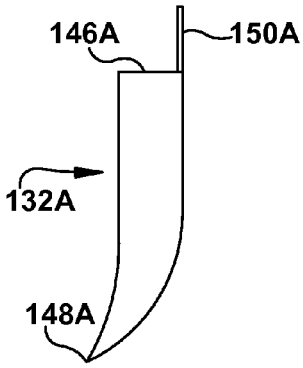
FIG. 7A is a perspective view illustrating a scoop-shaped dam member having a first connecting member.
Figure 7B:
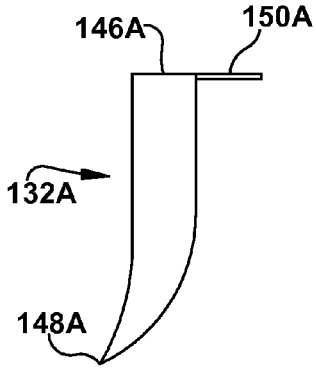
FIG. 7B is a perspective view illustrating a scoop-shaped dam member having a first connecting member.
Figure 7C:
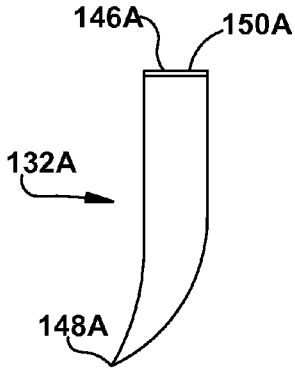
FIG. 7C is a perspective view illustrating a scoop-shaped dam member having a first connecting member.

To further improve the operation of the dam member 132 in either of the configurations of the airflow ducting assembly 130, an alternative member 132A, as shown in FIGS. 7A-7C, may be employed. As shown in FIGS. 7A-7C, the alternative dam member 132A is formed in a scoop shape wherein a lower edge 148A of the dam member 132A is disposed in a relatively forward or upstream direction relative to the upper edge 146A of the dam member 132A. This configuration may be employed so as to reduce the force of impingement of airflow on the dam member 132A, and to thereby reduce the amount of airflow which impinges on the dam member 132/132A and does not reach the transmission fluid cooler 128. In other words, the scoop shape of the alternative dam member 132A eases the redirection of airflow impinging on the dam member 132A. As also shown in FIG. 7A-7C, the alternative dam member 132A may include a connecting member 150A which: extends in a upward direction substantially flush with a rear surface of the dam member 132A (as shown in FIG. 7A); extends in a rearward direction substantially flush with the upper edge 146A of the dam member 132A (as shown in FIG. 7B); or is incorporated in the upper edge 146A of the dam member 132A.

With respect to the above described transmission fluid cooler assembly 110, it is noted that as configured and positioned, the airflow ducting assembly 130 is provided so as to better take advantage of the lower airflow A2 rather than strictly relying upon the upper airflow A1 introduced through ram air openings 122 and/or a portion of the lower airflow A2 which may naturally enter the vehicle component housing 102 through the bottom breather opening 124. In this regard, the generally lower disposition of the dam member 132 relative to the transmission fluid cooler 128 allows the lower airflow A2 to be better utilized in facilitating the cooling operation of the transmission fluid cooler 128. Moreover, though the dam member 132 overlaps with the radiator air dam 126, the radiator air dam 126 is sufficiently sized and positioned so as to receive a sufficient amount of airflow to facilitate the continued improved cooling operation of the radiator 108. As such, the transmission fluid cooling assembly 110, as disclosed herein, does not substantially adversely affect the operation of the radiator 108.

It is to be appreciated that the above-described transmission fluid cooling assembly 110 may be altered or reconfigured in various ways while remaining within the scope of the instant disclosure. For example, as mentioned above, the particular shape of the duct member 134, the dam member 132 or the air guides 136 may be altered. Additionally, while the airflow ducting assembly 130 is disclosed as being secured to the transmission fluid cooler 128, the airflow ducting assembly 130 may be secured to some other portion of the vehicle so long as the airflow outlet opening 142 is still positioned to communicate airflow guided through the airflow ducting assembly 130 toward the transmission fluid cooler 128. In this regard, the arcuate shape of the duct member front wall 138 may be reconfigured so as to have a rectilinear or other shape.

Additionally, the size of the passage defined by the duct member 134, as well as a length and width dimension of the air guides 136 and the dam member 132, may be increased or decreased depending on various design considerations. Moreover, it is to be appreciated that the dam member 132 may be alternatively sized, shaped, and/or positioned relative to the duct member 134 and/or the transmission fluid cooler 128 so as to best improve the amount of airflow which is directed and/or redirected toward the transmission fluid cooler 128. More particularly, the dam member 132 may be oriented at an angle relative to the front or upstream surface of the transmission fluid cooler 128.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A vehicle transmission fluid cooler assembly, comprising:

a vehicle transmission fluid cooler; and an airflow ducting assembly secured to the vehicle transmission fluid cooler and including a dam member which extends in a substantially downward direction from a lower portion of the vehicle transmission fluid cooler and is configured to direct airflow toward the vehicle transmission fluid cooler, the airflow ducting assembly further including a duct member joined to the dam member, the duct member and dam member cooperate to form an enclosed airflow passage connecting an airflow inlet opening at a front portion of the airflow ducting assembly and an airflow outlet opening at a rear portion of the airflow ducting assembly, said airflow outlet opening configured to communicate airflow passing through the airflow ducting assembly to the vehicle transmission fluid cooler.

2. The vehicle transmission fluid cooler assembly according to claim 1, wherein the dam member is positioned such that a front surface thereof is disposed in a forward direction relative to a front surface of the vehicle transmission fluid cooler.

3. The vehicle transmission fluid cooler assembly according to claim 1, wherein the dam member has a generally planar front surface.

4. The vehicle transmission fluid cooler assembly according to claim 1, wherein the dam member has a scoop shape with a lower edge disposed in a forward position relative to an upper edge of the dam member.

5. The vehicle transmission fluid cooler assembly according to claim 1, wherein the duct member comprises:

a front wall disposed in a forward position relative to a front surface of the vehicle transmission fluid cooler and the dam member; and a pair of side walls extending from the duct member front wall and forming side surfaces of the duct member, the pair of side walls engaging lateral side portions of the vehicle transmission fluid cooler at rear portions of the duct member sidewalls spaced from the duct member front wall, wherein a top edge of the duct member front wall cooperates with the rear portions of the duct member side walls to define the airflow outlet opening.

6. The vehicle transmission fluid cooler assembly according to claim 5, wherein the airflow ducting assembly further comprises:

air guides extending in a forward direction from each of opposed lateral ends of the dam member, the air guides having a top end which connects with a lower portion of the duct member.

7. A vehicle front end structure, comprising:

a vehicle component housing;

a vehicle radiator assembly housed within the vehicle component housing, the vehicle radiator assembly including a vehicle radiator and a radiator air dam which extends in a substantially downward direction from the vehicle radiator, a vehicle transmission fluid cooler assembly housed within the vehicle component housing and provided in a forward direction relative to the vehicle radiator assembly such that the vehicle transmission fluid cooler overlaps the vehicle radiator, the vehicle transmission fluid cooler assembly including a vehicle transmission fluid cooler and an airflow ducting assembly positioned in a forward and upstream direction relative to the vehicle transmission fluid cooler and configured to direct airflow toward the vehicle transmission fluid cooler.

8. The vehicle front end structure according to claim 7, wherein the airflow ducting assembly comprises a dam member which extends in a substantially downward direction from a lower portion of the vehicle transmission fluid cooler and which is configured to direct airflow toward the vehicle transmission fluid cooler.

9. The vehicle front end structure according to claim 8, wherein the airflow ducting assembly further comprises a duct member joined to the dam member, wherein the duct member and dam member cooperate to form an enclosed airflow passage connecting an airflow inlet opening at a front portion of the airflow ducting assembly and an airflow outlet opening at a rear portion of the airflow ducting assembly, said airflow outlet opening configured to communicate airflow passing through the airflow ducting assembly to the vehicle transmission fluid cooler.

10. The vehicle front end structure according to claim 9, wherein:

a lower wall defines a lower surface of the vehicle component housing;

the lower wall has a bottom breather opening defined therethrough; and the vehicle transmission fluid cooler assembly is disposed in a rearward downstream direction relative to the bottom breather opening, and the dam member is positioned to extend through the bottom breather opening so as to be partially disposed outside of the vehicle component housing.

11. The vehicle front end structure according to claim 8, wherein:

a lower wall defines a lower surface of the vehicle component housing;

the lower wall has a bottom breather opening defined therethrough; and the vehicle transmission fluid cooler assembly is disposed in a rearward downstream direction relative to the bottom breather opening, and the dam member is positioned to extend through the bottom breather opening so as to be partially disposed outside of the vehicle component housing.

12. The vehicle front end structure according to claim 7, wherein the dam member is disposed to at least partially overlap with the radiator air dam when viewed from a direction of airflow within the vehicle component housing.

13. The vehicle front end structure according to claim 7, wherein the vehicle component housing is defined by a front fascia forming a front surface of the vehicle component housing and a lower wall forming a lower surface of the vehicle component housing, wherein a ram air opening is defined in the front fascia and a bottom breather opening is defined in the lower wall.

14. A vehicle transmission fluid cooler airflow ducting system configured to engage and direct airflow toward a vehicle transmission fluid cooler, comprising:

a duct member defining an airflow passage connecting an airflow outlet opening to an airflow inlet opening, the duct member configured to engage a vehicle transmission fluid cooler such that the airflow outlet opening directs airflow toward the vehicle transmission fluid cooler, wherein rear edge portions of the duct member which define the airflow outlet opening are configured to engage upper and side edges of the vehicle transmission fluid cooler such that a plane defined by the airflow outlet opening is substantially flush with a front upstream surface of the vehicle transmission fluid cooler when the duct member engages the vehicle transmission fluid cooler.

15. The vehicle transmission fluid cooler airflow ducting system according to claim 14, further comprising:

a dam member secured to the duct member and extending downwardly therefrom such that a lower edge of the dam member is disposed below a lower edge of the vehicle transmission fluid cooler.

16. The vehicle transmission fluid cooler airflow ducting system according to claim 15, further comprising:

a pair of air guides secured to and extending in a forward direction from each of opposed lateral ends of the dam member, the air guides having a top end which connects with a lower portion of the duct member.

17. The vehicle transmission fluid cooler airflow ducting system according to claim 16, wherein the duct member comprises:

a front wall disposed in a forward position relative to a front surface of the dam member; and a pair of side walls extending from the front wall and forming side surfaces of the duct member, the pair of side walls being configured to engage lateral side portions of the vehicle transmission fluid cooler at rear side wall portions spaced from the front wall of the duct member, wherein a top edge of the front wall of the duct member cooperates with the rear side wall portions to create the airflow outlet, and the duct member is configured to be secured to the vehicle transmission fluid cooler such that the airflow outlet directs airflow toward a front upstream portion of the vehicle transmission fluid cooler.

18. The vehicle transmission fluid cooler airflow ducting system according to claim 15, wherein the dam member has a scoop shape with a lower edge disposed in a forward position relative to an upper edge of the dam member.

* * * * *